US008456958B2

(12) United States Patent
Felix et al.

(10) Patent No.: US 8,456,958 B2
(45) Date of Patent: Jun. 4, 2013

(54) CAPACITIVE MICRO-MACHINED ULTRASONIC TRANSDUCER FOR ELEMENT TRANSDUCER APERTURES

(75) Inventors: Nicolas Felix, Tours (FR); Aimé Flesch, Andrésy (FR); Remi Dufait, Tours (FR); An Nguyen-Dinh, La Riche (FR)

(73) Assignee: Vermon S.A., Tours (FR)

( * ) Notice: Subject to any disclaimer, the term of this patent is extended or adjusted under 35 U.S.C. 154(b) by 2175 days.

(21) Appl. No.: 11/357,079

(22) Filed: Feb. 21, 2006

(65) Prior Publication Data

US 2007/0193354 A1 Aug. 23, 2007

(51) Int. Cl.
*H04R 19/00* (2006.01)

(52) U.S. Cl.
CPC ..... *H04R 19/00* (2013.01)
USPC ..... 367/181

(58) Field of Classification Search
CPC ..... H04R 19/00
USPC ..... 367/189, 181; 438/22, 48; 257/416
See application file for complete search history.

(56) References Cited

U.S. PATENT DOCUMENTS

| | | | |
|---|---|---|---|
| 5,619,476 A | 4/1997 | Haller et al. | |
| 5,870,351 A | 2/1999 | Ladabaum et al. | |
| 5,894,452 A | 4/1999 | Ladabaum et al. | |
| 6,262,946 B1 | 7/2001 | Khuri-Yakub et al. | |
| 6,381,197 B1 | 4/2002 | Savord et al. | |
| 6,918,877 B2 | 7/2005 | Hossack et al. | |
| 2007/0193354 A1 * | 8/2007 | Felix et al. | 73/514.32 |

FOREIGN PATENT DOCUMENTS

| | | |
|---|---|---|
| EP | 1 764 162 A1 | 3/2007 |
| EP | 1 779 784 A1 | 5/2007 |
| WO | WO 2007/013814 A2 | 2/2007 |
| WO | WO 2007/013814 A3 | 2/2007 |
| WO | WO 2009001157 A1 * | 12/2008 |

OTHER PUBLICATIONS

Wong et al; "Curved Micromachined Ultrasonic Transducers"; 2003 IEEE Ultrasonics Symposium; pp. 572.576.

* cited by examiner

*Primary Examiner* — Daniel Pihulic
(74) *Attorney, Agent, or Firm* — Stites & Harbison PLLC; Jeffrey A. Haeberlin

(57) ABSTRACT

A capacitive micro-machined ultrasonic transducer (CMUT) array includes an improved elementary aperture for imaging operations. The transducer can be of a linear, curved linear, annular, matrix or even single surface configuration. The elementary apertures thereof are formed by a specific arrangement of capacitive micromachined membranes (CMM) so as to exhibit ideal acoustical and electrical behavior when operated with imaging systems. The CMM arrangements can be either conventional where the element transducers of the array are uniformly shaped by predefined CMMs in a manner such as to exhibit acoustic behavior similar to a piezoelectric transducer, or can be more sophisticated, wherein each element transducer is formed by a specific combination of different CMMs (i.e., of a different size and/or shape) so as to provide the transducer with built-in acoustic apodization that can be implemented in the azimuth and/or elevation dimension of the device.

11 Claims, 6 Drawing Sheets

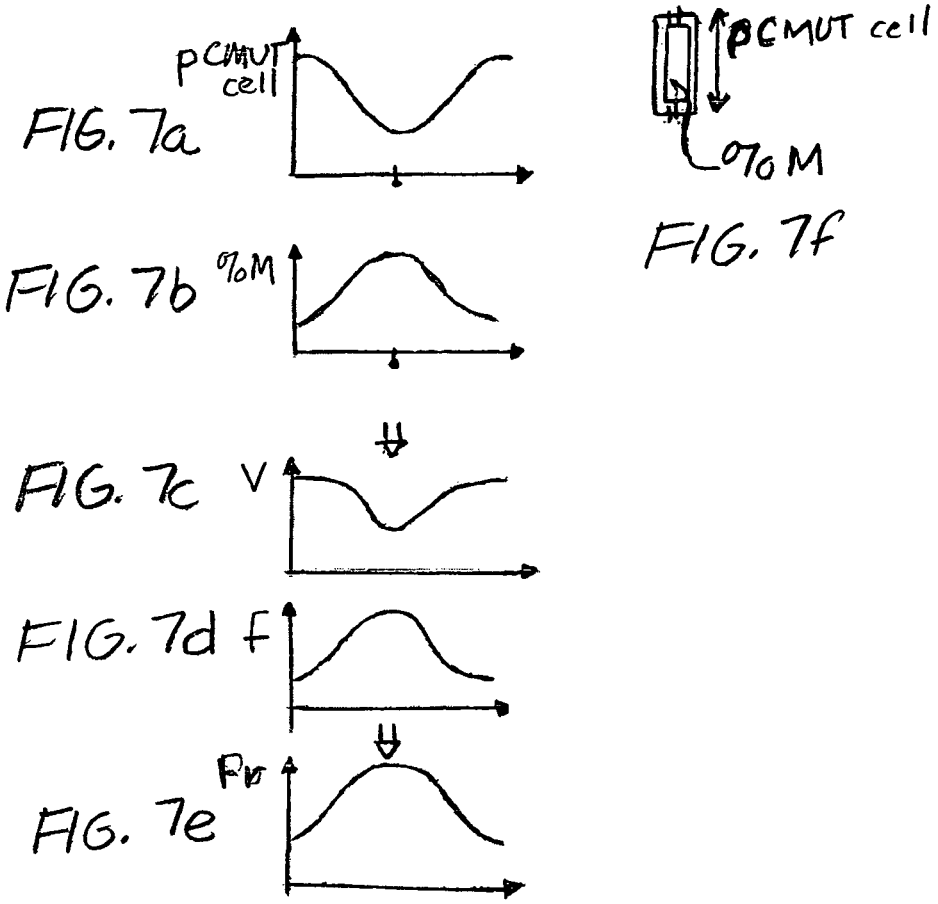
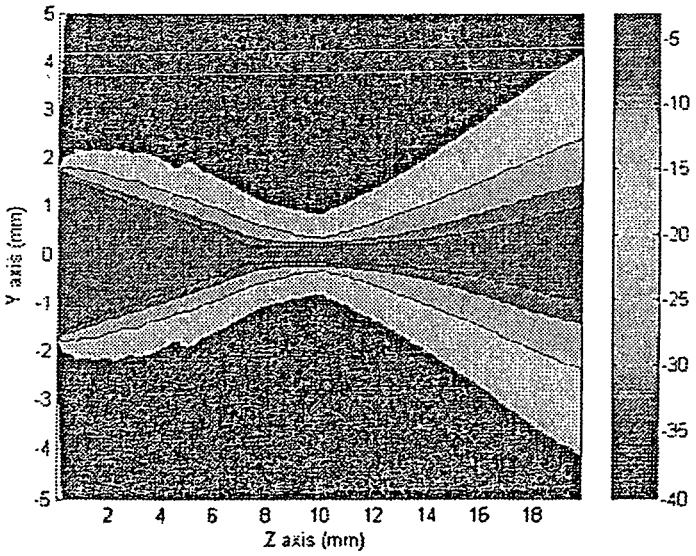
FIG. 8a

CAPACITIVE MICRO-MACHINED ULTRASONIC TRANSDUCER FOR ELEMENT TRANSDUCER APERTURES

FIELD OF THE INVENTION

The present invention relates to ultrasonic transducers and, more particularly, to capacitive micro-machined ultrasonic transducers.

BACKGROUND OF THE INVENTION

Ultrasonic transducers are typically formed with one vibrating surface or a plurality of vibrating surfaces capable of converting electrical energy into mechanical displacements and vice-versa. Because the acoustic pressure produced by such devices obeys diffracting laws, physical parameters such as area, frequency, bandwidth, geometry and surface apodization (weighting) are key factors in transducer design and actually govern the radiating acoustic beam pattern produced by the transducer.

The operation of single area transducers is often characterized by spurious boundary effects, which are manifested by secondary lobes occurring laterally of the main lobe. These effects generally occur when the ratio factor between the Z and the X-Y dimensions does not satisfy a certain value. On the other hand, array transducers require substantially perfect and well controlled angular directivities of the corresponding transducer element apertures in order to produce smooth radiating acoustic beam patterns compatible with the formation of a high quality image. Based on the above considerations, designers of ultrasonic transducers often seek to balance performance with the geometry of the transducer.

To date, piezoelectric array transducers are principally of a bulky design wherein a portion of the piezoelectric material is slotted into narrow independent blocks which are isolated from each other and arranged in side by side relation in the azimuth direction. The piezoelectric material is uniformly poled and is of a thickness that is predetermined to provide the desired resonant frequency. Accordingly, the geometry of elemental transducers is, therefore, essentially determined or set at this initial design stage. Further modification of the geometric parameters set at this initial stage is difficult to effect, and, further, will strongly affect the intrinsic acoustic behavior of the transducer device. Usually, taking advantage of any trade-offs with respect to the geometrical specifications of a transducer involves compromise regarding performance and/or cost.

In the recent years, a new family of devices, commonly called CMUTs (Capacitive Micromachined Ultrasonic Transducers) and using semiconductor capacitive micromachined cavities for producing ultrasound, has appeared on the market. These CMUT devices generally have the advantage that, on one hand, collective manufacturing processes (mass production) can be used in making the devices, and, on the other hand, the devices exhibit a broader bandwidth as compared to piezoelectric assemblies. The basic principles of such a device are quite simple and these principles have been successfully implemented for years in the manufacturing of condenser microphones. However, in capacitive transducers, the transducer is governed by a voltage oscillation over an electrostatic field (bias voltage). This oscillation causes the membranes over the cavity to vibrate and to therefore produce output ultrasonic waves. Conversely, when a pressure force acts on the surfaces of the biased membranes, this results in mechanical bending of the membranes and, thus, in creation of an output voltage oscillation. Both the excitation and receiving voltages are provided by the associated imaging system which remains essentially unchanged, i.e., is very similar to existing imaging systems.

Although inherent drawbacks in such capacitive devices still remain (e.g., drawbacks such as device fragility, a biased voltage requirement, a long prototyping cycle, and high volume production needs) such drawbacks will likely be overcome with advances in the microelectronics and sensors technologies. In any event, CMUT devices exhibit certain unique advantages such as the ability of these devices to be integrated readily with microelectronics for immediate signal processing so as to improve the quality of the received information, and the higher degree of miniaturization that can be achieved using these devices. Thus, it can be predicted that in the near future CMUT devices will outperform conventional transducer technologies.

A number of manufacturing methods for CMUT devices have been developed and are currently well known in the art. A common basic method for manufacturing CMUTs comprises at least the following steps: a silicon substrate is provided with an oxide layer deposited on the surface of the substrate; electrodes are patterned over the oxide layer; a sacrificial layer is then deposited thereon and then photolithographically patterned to define cavities to be created in further steps; a silicon nitride layer is deposited over the substrate; vias are dry-etched, and the membrane is released using wet etching techniques on sacrificial layer; the vias so obtained are then sealed; and finally, an outer electrode is sputtered on the top of the membranes. Reference is made, for example, to U.S. Pat. Nos. 5,894,452 and 5,870,351 to Ladabaum et al and U.S. Pat. No. 5,870,351 to Haller.

Other manufacturing methods exist such as bulk micromachined processes where 3D patterns are etched on layers of silicon and then the layers are bonded together at high temperature, under a vacuum, to form the desired cavities.

Methods for integrating electronics on the substrates of CMUT devices have been developed which use a BiCMOS process or low temperature process. This has made the capacitive transducing devices very attractive for the future development of highly integrated ultrasonic imaging systems. Since the devices are manufactured as silicon components or ICs, the packaging and interconnect aspects of manufacture will advantageously benefit from the most recent developments in these fields so as to keep manufacturing of CMUT devices at the leading edge of the relevant technology.

A method for reducing undesirable interaction between elemental transducers (transducer elements) of an array is disclosed In U.S. Pat. No. 6,918,877 to Hossack et al. In this method, the cross talk between the adjacent transducer elements of an array is measured or calculated, and modified excitation signals, derived from signals relating to the selected element, are then applied to the neighboring elements to interfere with any cross talk and thus reduce the effect of the cross talk. As mentioned in the patent, the method can be implemented in most array designs and is especially well adapted to silicon substrate-based MEMS (Micromachined Electro Mechanical Systems) transducers. Although methods such as those based on coded signals or post-calculated signals can be of suitable efficiency, the implementation of such methods in commercial systems presents another challenge. In this regard, in the aforementioned method, an individual adjustment is required for every transducer or type of transducer in order for the method to work properly. Any variation in cross talk or performance, and any lack of homogeneity between elemental transducers of the array, necessitate the requirement that the system must be recalibrated and fine tuned. Thus, this method disclosed in this patent is obviously better suited to laboratory uses than to industrial applications.

A patent that is more closely related to transducer aperture control and apodization methods is U.S. Pat. No. 6,381,197B1 to Savord et al. This patent discloses a CMUT device that includes a variable gain control for MUT cells which are integrated into the substrate of the device. The patent is principally concerned with the use of integrated electronic control circuitry implemented on a common substrate rather than the CMUT devices, switches or microrelays which are provided as well as the passive components such as resistors or capacitors used to control the bias voltage source for the MUT cells. In one of the embodiments, there is provided another method of gain control for CMUT cells wherein the diameter of CMUT cells can be changed or the distance between the CMUT cells can be varied or a combination of the two approaches can be used. The patent discloses that with respect to a change in cell diameter, the larger the CMUT cells, the higher the acoustic energy provided. Unfortunately, when this approach is applied to circular shaped CMUT cells as disclosed by Savord et al. The approach suffers several shortcomings For example, the variation in the diameter of the cells will inherently result in more wasted or void area between the cells, and, therefore, the density of cells on the transducer or the effective vibrating surface of the transducer will not change. In practice, this approach as applied to circular shaped CMUT cells has no significant impact on the acoustic output of the device and will, at best, only affect the resonant frequency of the transducer.

With regard to the discussion above regarding transducer design trade-offs and the behavior of ultrasonic transducers using capacitive membranes (also referred to as cells) as vibrating elements, it will be appreciated that the cells of CMUTs must be carefully tailored to produce the final characteristics desired. In practice, a major task for a designer will thus be the determination of a suitable cell geometry and behavior (i.e., stiffness) in order to provide the CMUT with the desired electrical and acoustical characteristics. In doing this, an optimized cell structure has to first be determined and thereafter this structure has to be repeated over an area of the substrate so as to provide an elemental transducer.

It is also well known that shaping of the cells is essential in the optimization of transducer surface mapping. In this regard, membranes or cells that are shaped as polygons or rectangles are better suited for minimizing the non-functional area of the substrate. As aforementioned, the silicon substrate is generally populated with thousands of CMMs (Capacitive Micromachined Membrane) which are organized in small groups which are connected together. Thus, each group of CMMs forms an elemental transducer (transducer element). A suitable interconnection means is then optionally provided at the sides of the transducer to facilitate further assembly operations. Since the silicon substrate is set in wafers, and the processing cycles are long time consuming tasks, each wafer of the substrate will be fully patterned with transducer masks in order to reduce costs and processing time and so that the mapping of the substrate surface can be carried out with different transducer designs, as required.

Turning to CMUT array construction and manufacture, the elemental transducers are formed as a combination of a plurality of shunted CMMs. These transducer elements are separated from each other by a kerf or small space that physically isolates the adjacent elements. The kerfs are made as narrow as possible to prevent the loss of sensitivity but should be of such a width as to provide an adequate acoustic barrier against acoustic cross talk between adjacent transducer elements. Earlier CMUT devices that have been shaped to form arrays were not diced, and measurements carried out with respect to such devices have demonstrated that the bulky silicon kerfs employed provide a very weak acoustic barrier so that the image quality provided by such devices is quite inferior to that of standard transducer devices.

Further developments in CMUT construction include improvements in the transducer characteristics provided by implementing dicing, and using polymer filled kerfs in combination with high loss backing members to better meet the requirements of high quality beamformers. Dicing of the CMUT device will further provide the device with the ability to bend longitudinally. This enables the formation of curved arrays of the type that are in widespread use in medical applications.

In other publications to Ladabaum et al., Sensant Corp. (Curved Micromachined Ultrasonic Transducers, K. A. Wong, s. Panda and I. Ladabaum; IEEE-UFFC Symposium 2003), the authors disclose another technique for bending the substrate, including a step of thinning the material from the back side thereof by grinding of the substrate. The grinding operation is carried out through the thickness of the substrate to such an extent as to impart flexibility. In this regard, the transducer is made sufficiently flexible to uniformly conform to a desired radius of curvature. This process is limited by the great fragility of the substrate after the grinding operation, thus making all further manufacturing operations more delicate than with conventional techniques.

SUMMARY OF THE INVENTION

With the above described prior art as a background, and also considering the relevant background with respect to synthetic beamforming techniques for slotted transducers, in accordance with one aspect of the invention, ultrasonic devices (whether single elements or arrays) that are used for imaging and that employ capacitive micromachined membranes are greatly improved through the implementation of novel methods of mapping transducer surfaces so as to customize the acoustic radiation of the transducer apertures according to the requirements of high quality or harmonic imaging systems and so as to enhance the electrical impedance characteristics of the transducer devices with respect to the associated electronics.

Another aspect of the present invention concerns the provision of a method of shaping a CMUT device which includes customized optimization or apodization (weighting) of the CMMs forming the transducer surface. Preferably, the apodization of the CMMs is performed in amplitude and/or in frequency to enhance the quality of the acoustic beam pattern and, in particular, so as to decrease the side lobes (for arrays) or the lateral lobes (for single surfaces) of the devices.

Another aspect of the invention concerns a method of frequency apodization applied to the surface of a transducer which involves providing a specific geometry of CMMs in a manner so that the CMMs operate with a graded frequency distribution from the center of the transducer surface to the edges thereof.

Yet another aspect of the invention concerns the implementation of a frequency apodization function with respect to elemental apertures of an array transducer (whether 1D, 1.5D or 2D) so as to improve the lateral radiating pattern. The apodization function used is preferably determined according to gaussian or hamming distribution laws or the like.

Yet another aspect of the invention relates to optimization of the dimensions and geometry of CMMs in such a manner as to improve the behavior of a transducer element of a corresponding array. This behavior can be electrical and acoustical. Preferably, each element has a specific CMM design and distribution.

In accordance with another aspect thereof, the present invention relates to particular surface mapping configurations of a Capacitive Micromachined Ultrasonic Transducer (CMUT) where Capacitive Micromachined Membranes (CMM) are specifically tailored and arranged on the front surface of the transducer device so as to enable customization of the acoustical and electrical behavior of the device. The method of this aspect of the invention is well suited to arrayed imaging transducers wherein the characteristics of the individual transducers are crucial in achieving quality images. However, the method is also applicable to single surface (area) transducing devices, and when so implemented, this method prevents edge effects and significantly improves the acoustical beam pattern and/or frequency response, thereby enabling a designer to custom shape of the acoustical output of the transducer device whatever the footprint of device.

In another aspect of the invention, the arrangement of the CMMs over the surface CMUT provides the surface with an optimized apodization function, thus improving the output acoustical beam pattern. The apodization functions that can be employed include those based on well known gaussian or hamming distribution functions commonly used in advanced imaging. Advantageously, the apodization obtained with specific sampling of the CMMs can be used to simultaneously control both the amplitude and resonant frequency of the transducer device without any compromising of the intrinsic performance of the device.

Yet another aspect of the invention concerns apodization of the elemental apertures of array transducers. Generally speaking, an array transducer designed for use in imaging applications is comprised of a plurality of independently individually addressable elements or element apertures. In accordance with this aspect of the present invention, the addressable elements are individually formed by a plurality of CMMs having a shape and an area which are optimized to provide an amplitude and frequency apodization function in both the azimuth and elevation directions. Application of this method to transducer array devices provides a customized smoothing of the physical boundaries of the transducer elements, thereby preventing the occurrence of side lobes.

A further aspect of the invention is concerned with an improvement of the electrical behavior of the CMUT devices, particularly in arrayed transducer constructions wherein the transducer elements are of very narrow dimensions and the electrical impedance thereof is inherently highly mismatched to that of the transmission line, thereby creating spurious reflections and signal disturbances that affect the pulse shape and frequency response accordingly. The physical characteristics of the CMMs are tailored so as to maximize the capacitance of the membranes, thereby enhancing the efficiency of the elements of the transducer array. The value of the electrical impedance (specifically, the imaginary part) of the array elements is, therefore, reduced, and thus the elements are seen as more resistive than in conventional CMUT designs.

The methods of apodization for CMUT devices discussed below relate to preferred embodiments and these discussions are provided to demonstrate innovative aspects of the invention and the improvements provided over the prior art. However, this further discussions is not intended to limit or restrict in any way to the methods.

Further features and advantages of the present invention will be set forth in, or apparent from, the detailed description of preferred embodiments thereof which follows.

BRIEF DESCRIPTION OF THE DRAWINGS

The present invention as defined in the claims can be better understood with reference to the drawings discussed below but it will be appreciated that the components included in the drawings are not necessarily to scale relative to each other, with emphasis being placed instead being placed upon simplicity and clarity in illustrating the principles of the present invention.

FIG. 5*a* is a plan view of a CMM while

FIGS. 7*a* to 7*e* are curves showing the impact of membrane optimization on different characteristics of the CMM;

FIG. 7*f* is a plan view of an exemplary cell used in explaining FIGS. 7*a* and 7*b;*

FIG. 8*a* depicts modeling of an acoustic beam pattern for a non-apodized element of a CMUT;

DESCRIPTION OF THE PREFERRED EMBODIMENTS

Before describing the preferred embodiments of the invention, it is noted that in the discussion below, the term "element transducer" (or "element transducers") refers to a sub-element aperture of an array transducer and usually comprises a plurality of transducer elements arranged on the full aperture. The term is only applicable to array type transducer apparatus and is not used in connection with single surface transducers. The term "CMM" (or "CMMs") designates capacitive cells that are machined on or etched into the surface of a silicon substrate in such a manner as to form a transducer surface when a sufficient number of cells are provided. The term "CMUT" (or "CMUTs") designates an ultrasonic transducer comprising a plurality of CMMs or a plurality of CMM groups.

As indicated above in the description of the prior art, CMUT devices can be shaped in various ultrasonic transducer configurations whatever the application or modality. In the following detailed description of some important embodiments of the invention, FIGS. 1 and 2 depict, respectively, a conventional ultrasonic piezoelectric transducer (FIG. 1) and the mechanism involved in the emission and reception of ultrasonic waves through pulse excitation of a piezoelectric element or plate (FIG. 2).

Figure 1:
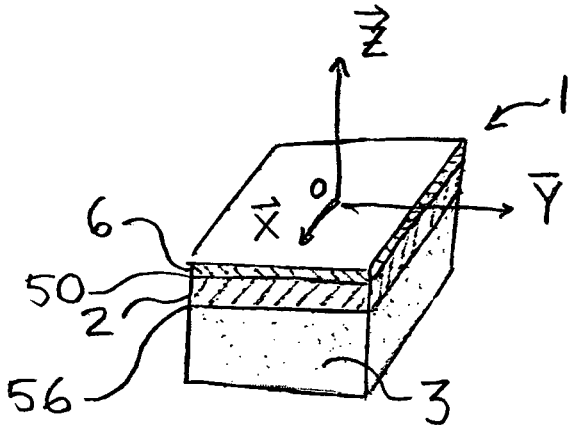
FIG. 1 is a schematic perspective view of an ultrasonic transducer assembly.
Figure 2:
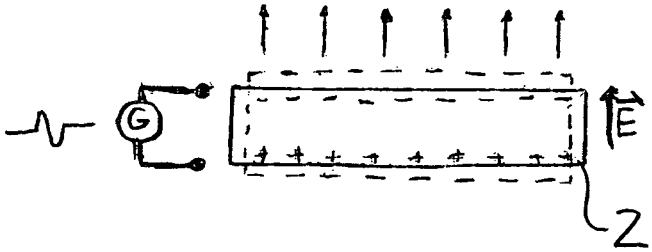
FIG. 2 is a schematic side elevational view of a piezoelectric plate member demonstrating the principle of a piezoelectric plate member vibrating in a thickness mode to provide propagation of ultrasonic waves.

More particularly, in FIG. 1, a typical transducer 1 comprises a piezoelectric member 2 having electrodes 5*a* and 5*b* plated or otherwise provided on the major faces thereof in a manner so as to preferably excite the thickness mode of the transducer along with the Z axis, perpendicular to the major surfaces of the transducer. The front face of the piezoelectric member 2 is attached to a set of matching layers adapted to provide smooth transmission and reception of acoustic energy. On the back side of the piezoelectric member 2 a backing block 3 is provided which is adapted to cancel reverberations or reflections that are undesirable in the production of acceptable images. Because the piezoelectric member 2 is manufactured using a high pressure and temperature process, surface displacements are quite uniform over the area of the member, so that control of the acoustic beam produced by the transducer can be carried out by shaping the dimensions of the piezoelectric member 2 using well known principles relating to radiating effects through a finite aperture.

Figure 3:
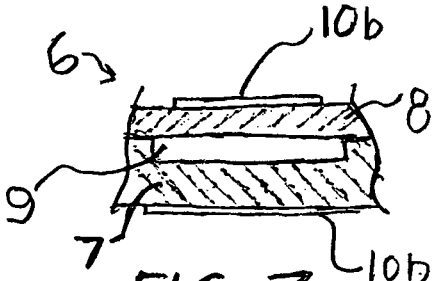
FIG. 3 is a cross sectional view of a CMM (capacitive micromachined membrane)

In a capacitive apparatus such as a CMUT device, the operating principles are quite different than those associated with conventional transducers. The transducer of such CMUT devices is of a planar type which means that the thickness of the transducer substrate has no impact on the frequency and amplitude of the output acoustic beam. A typical ultrasonic capacitive device that can be used to build CMMs is shown in FIG. 3 wherein a cell 6 is formed by depositing a membrane 8 of non-conductive material onto a substrate 7. Substrate 7 includes a thin gap or shallow recess thereon which results in the formation of a cavity 9. Electrodes of the capacitive cell 6 are provided by conductive layers 10*a* and 10*b* respectively deposited on the front and back surfaces of the cell 6.

Methods for producing such a cell structure have been widely disclosed in the literature and these methods have intrinsic advantages and inherent drawbacks. Because of this, selection of a suitable manufacturing method for such capacitive cells is governed by different criteria such as: (i) type of transducer, (ii) quantity, (iii) the device to be produced, (iv) performance, and (v) costs.

An example will now be provided of a manufacturing process applicable to capacitive devices according to the main objects of the invention, wherein a CMOS processing technology is used to produce silicon-based capacitive cells of the type shown in FIG. 3. In this example, substrate 7, which is referred to as the carrier for the electrostatic cells, is made up of a silicon. An intrinsic silicon substrate can also be used with the addition of metal electrodes deposited in the cavity of the cells on the surface of the substrate.

In the next step of process, an oxide layer (e.g., a silicon dioxide ($SiO_2$) layer) is then deposited on one or both surfaces of the substrate 7 to provide electrical insulation for the substrate. Doped polysilicon is deposited by LPCVD to create the bottom electrode, and the deposit can be patterned so as to reduce parasitic capacitance. A sacrificial layer process is preferably used to create cavities above the membranes. The sacrificial layer can beneficially be an oxide which exhibits a higher etch rate as compared to a nitride.

A layer of silicon nitride is then deposited on the oxide layer to form the membrane 8. The silicon nitride layer may, for instance, be produced using a LPCVD (Low Pressure Chemical Vapor Deposition) process or PECVD (Plasma Enhanced Chemical Vapor Deposition) process in order to obtain a low stressed layer on the front face of device. Typically, a residual stress of less than 250 MPs for the silicon nitride layer is desired. However, this stress can vary according to the particular specifications of the transducer.

Preferably, the front electrode 10*a* is provided at this stage of the manufacturing process. Electrode 10*a* is advantageously produced by a sputtering process and can be sputtered to a thickness of within 250 nm.

Figure 4:
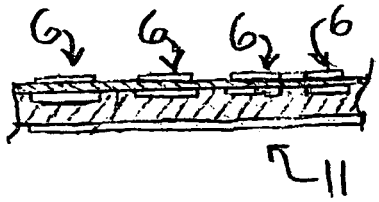
FIG. 4 is a cross sectional view of a CMUT (capacitive micromachined ultrasonic transducer) device including a plurality of CMMs arranged on a major surface thereof.

Because the dimensions of capacitive cells are very small (in the micron range), a combination of a plurality of CMMs electrically connected together is used to form a transducer area for emitting and receiving ultrasonic waves. Referring to FIG. 4, a schematic representation of an ultrasonic transducer 11 is shown wherein a plurality of CMMs, denoted 6, and corresponding to CMMs $\mathbf{6}_1 \ldots \mathbf{6}_n$, are connected to a common ground electrode at the bottom side of the transducer. The front electrodes of the CMMs 6 can be also connected together but this is not required because a plurality of pulsers can be used to drive the front electrodes individually.

In FIG. 4, transducer 11 is shown as being formed by a group of similar CMMs uniformly disposed on the upper surface of transducer 11. It is to be understood that this representation is provided for the sake of simplicity, i.e., to simplify the description of the applicable principles here. However, it will be appreciated that CMMs can be designed so as to have many different kinds of shapes and dimensions in order to optimize use of the available transducer surface and thus to maximize the sensitivity of the device. For example, CMMS shapes such as polygons or rectangles have been used. Further, it will be understood that the CMMs are also mapped out over the transducer surface in two directions as well.

Figure 5A:
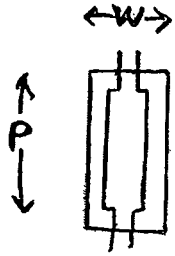
Figure 5B:
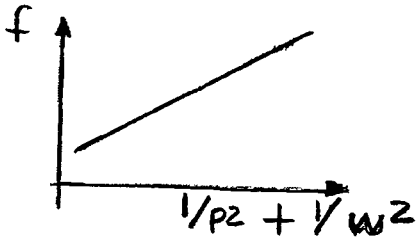
FIG. 5*b* shows a frequency curve versus membrane size of the CMM.

Referring to FIGS. 5*a* and 5*b* and 6*a* and 6*b*, these figures illustrate the impact of CMM membrane size and electrode surface ratio on the frequency and the collapse voltage of the corresponding transducer device. It is of particular interest to observe in FIG. 5*b* how the membrane size or membrane shape ratio affects and controls the variation in resonant frequency of the transducer device. Referring to FIG. 5*a*, for a length p and a width w for the cell as shown, the frequency f in FIG. 5*b* is plotted as a function of the quantity $1/p^2+1/w^2$. The plot shown in FIG. 5*b* demonstrates that control of the membrane shape ratio is a powerful tool for adjusting the frequency distribution over the surface of the transducer, as is further described below in the description of specific preferred embodiments.

Figure 6A:
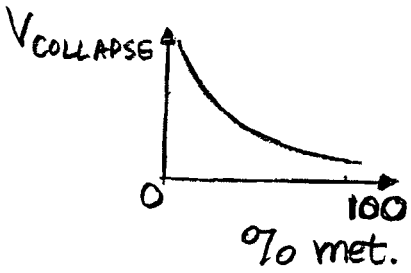
FIGS. 6*a* and 6*b* show the influence of the electrode coverage on the surface of a CMM, with FIG. 6*a* showing a collapse voltage curve plotted as a function of the percentage of metallization percentage for the CMM and FIG. 6*a* showing frequency plotted as a function of the percentage of this metallization.
Figure 6B:
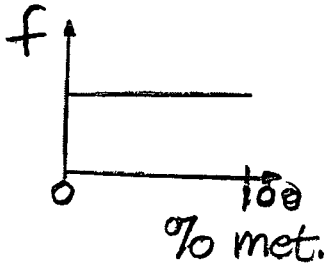

FIG. 6*a* shows how the percentage of the electrode area, i.e., percentage of the metallization of the cell surface (a partially metallized surface being shown in FIG. 5*a*) can impact on the "collapse voltage" phenomenon which is commonly observed in CMUT devices. To explain, because capacitive devices for ultrasonic production are obtained from the vibration of thin membranes mounted over an extremely thin gap or cavity (i.e., a gap or cavity having a depth on the order of dozens of nanometers), the maximum acceptable voltage before the membrane comes into contact with the bottom surface of the cavity is commonly referred to as the "collapse voltage" and can be approximated by the formula:

$$V_{coll} \cong \sqrt{\frac{8kd_0^3}{27\varepsilon_0 S}},$$

with k being the rigidity constant of membrane/electrode sandwich, $\epsilon_0$ being the permittivity of free space, S being the membrane surface, and $d_0$ being the gap thickness This voltage defines a limit that is not to be exceeded if linear behavior of the membrane is desired. FIG. 6*a* shows the variation in the collapse voltage of the CMM versus the percentage of the electrode material (electrode plating or metallization) present on the surface on the CMM with the resonant frequency held constant.

As previously discussed, the dimensions (i.e., the length p and width w as depicted in FIG. 5*a*) of the membrane and the percentage of the electrode plating on the membrane are crucial aspects in controlling CMM operations. FIGS. 7*a* to 7*e* summarize the expected effects of these variations on different parameters of the device. FIGS. 7*a* to 7*e* respectively show the effect of variations in cell length (p CMUT cell), % of electrode coverage or metallization (% M), voltage (voltage collapse), frequency f and output pressure Pr. FIG. 7*f* is a plan view of capacitive membrane provided to better show how the cell surface can be shaped with respect to the footprint thereof (p CMUT cell) and the percentage of the electrode coverage, i.e., metallization (% M).

Figure 8B:
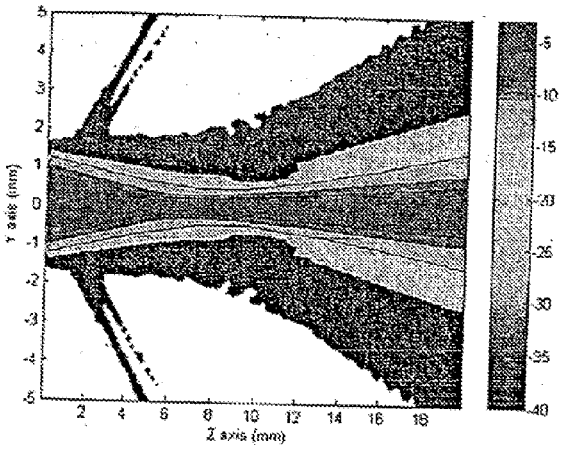
FIG. 8*b* depicts modeling of an acoustic beam pattern for an apodized element of a CMUT.

Referring to FIGS. 8*a* and 8*b*, modeling of the acoustic beam patterns from the transducer aperture without apodization is shown in FIG. 8*a* and with apodization in FIG. 8*b*. These figures clearly show the benefit that can be obtained when apodization is adequately applied. In particular, the effect of the apodization function on the shape of the beam patterns is illustrated, and, as shown, a significant improvement in the beam shape is obtained. Of course, further enhancement of the beam pattern can be achieved by providing other apodization functions with respect to the corresponding transducer aperture.

Practically speaking, apodization functions have much greater impact when applied to array designs wherein the sizing of different components of the array strongly affects the final performance by the array in terms of the size of the side lobes, the shape of the beam pattern and the pulse shape of the transducer. Conventional piezoelectric array imaging systems often provide electronic apodization functions to synthetic acoustic apertures (electronic linear array systems) in order to improve the quality of the images obtained. In such systems, the output level of the excitation provided for every transducer element is individually controlled by the system so as to produce a smooth gaussian shape over the width of the aperture.

Figure 9:
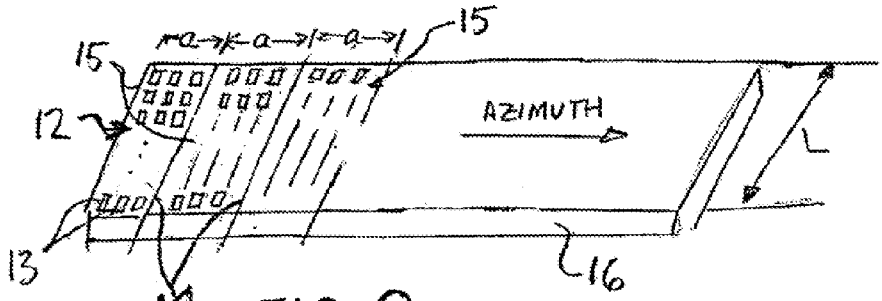
FIG. 9 is a schematic perspective view of a CMUT array device used for imaging.

Referring to FIG. 9, there is shown a conventional arrayed CMUT 12. CMUT 12 comprises a silicon substrate 16 serving as carrier for a plurality of CMMs 13 carried thereby. The arrayed CMUT device 12 includes a plurality of element transducer surfaces 15 which are formed by a plurality of CMMs 13 separated by associated passive kerfs 14 which preferably comprise bulk silicon. The arrayed CMUT device 12 has two major axes, viz., an azimuth axis where the element transducers are arranged with apertures (a) and an elevation axis wherein the geometrical focus is defined by curving the array or by adding a (e.g., silicon rubber) lens or lens assembly. The transducer elements extending in the azimuth direction are controlled by the system, while in the elevation direction, a hard focus must be employed in order to perform a focal adjustment. In conventional practice, the arrayed transducer 12 has a much larger azimuth dimension than elevation dimension, but in phased array devices there can be only a small difference between the two dimensions since the phase shift of the transducer excitations is applied to steer the acoustic beam and, as a result, the synthetic aperture does not physically move (slide).

Figure 10:
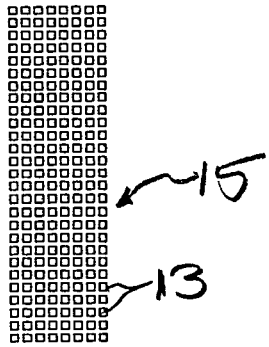
FIG. 10 is a plan view showing conventional mapping of an element transducer of a CMUT array having capacitive membranes of an identical shape.

It will be evident to one skilled in this art that all of the CMMs 13 of a given element transducer 15 are connected so as together to respond simultaneously when excited. FIG. 10 perhaps better illustrates the details of a single element transducer 15 formed by arrangement of CMMs 13 as described above in connection with FIG. 9. The shape of the CMMs 13 in FIG. 10 is an example of one of many possible shapes, i.e., the CMMs can be designed in many different ways so long as the designs are technologically feasible based on the technologies that are available at the time or that become available. As can be seen in FIG. 10, the footprint of the element transducer 15 is obtained by mapping the surface thereof with single CMMs 13. The rectangular footprint shown is only shown for purposes of clarity of the illustration, and essentially any other shape can be obtained without difficulty. This is in contrast to conventional array transducers where dicing is required to physically separate two adjacent elements, thus making it difficult to produce any element shapes other than rectangular.

In one preferred embodiment of the invention, an arrayed CMUT device is provided with an element transducer similar to that shown in FIG. 9 wherein a plurality of the elements of the CMMs are regularly disposed along the azimuth axis and each elemental transducer is composed of, and its surface defined by, an arrangement of CMMs which exhibit a first, smaller dimension "a" in the azimuth direction and a second larger dimension "L" in the elevation direction as shown in FIG. 9. In this implementation, all element transducers are assumed to be identical in size and frequency in the preferred embodiment, so that this approach is compatible with linear array construction and operations (wherein the synthetic acoustic aperture shifts back and forth along the azimuth axis). The element aperture size is defined according to the requirements of synthetic electronic array systems wherein the pitch is usually of a value ranging from one-half to two wavelengths of the transducer. Every element is independently driven by excitation circuitry so that electronic apodization functions can still be applied, as is the case in existing transducer devices.

Figure 11:
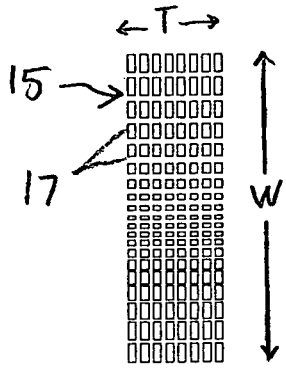
FIG. 11 is a plan view illustrating a method of apodization of an element transducer in accordance with one embodiment of the invention.

One feature of the method and apparatus disclosed herein concerns the apodization of the element transducer itself by implementing shifting functions with respect to the sizes of the single CMMs that cover the surface of the element transducer. This is illustrated in FIG. 11, wherein CMMs 17 are arranged in two orthogonal directions (the t direction in FIG. 11) to form the active surface of the element transducer 15, i.e., in the width direction as viewed in FIG. 11. In the horizontal direction, the pitch of CMMs 17 is uniform so that each vertical line of CMMs 17 is identical to the others. Thus, all CMMs 17 located on the same horizontal line are identical in construction and will operate the same way. In contrast, in vertical dimension (the w direction) a plurality of horizontal lines of CMMs 17 are formed wherein the heights of the individual CMMs 17 vary progressively from the center of the element transducer to both outermost edges, so that the height of the CMMs 17 is relatively small in the middle and relatively large at the two ends. The height variation function, i.e., the manner in which the heights of the CMMs 17 vary, can be determined based on linear or gaussian or any other mathematical shifting functions. The choice of shifting function is determined by the final acoustical beam shape that is desired.

As previously discussed in connection with FIGS. 5 and 7, the membrane dimensions of a CMM strongly impact on such intrinsic parameters of the transducer as output sensitivity and frequency. With regard to the arrangement shown in FIG. 11, the resultant element transducer 15 will have the amplitude and frequency thereof shifted from the center to the outermost edges. This will result in a vibration function that is implemented with a customized apodization, in this case, in the w direction, as illustrated. Further, if the w dimension is made much larger than the t dimension, the configuration of the element transducer shown in FIG. 11 would then correspond to an elevational apodization that would be beneficial to a transverse transducer focus. In contrast, if the w dimension is made much smaller than the t dimension then apodization effect will be applied to the azimuth direction of the transducer, as shown in FIG. 9, so the angular directivity of the element transducer is affected.

Figure 12:
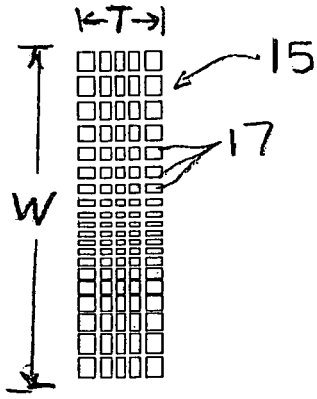
FIG. 12 is a plan view illustrating another method of apodization of an element transducer in accordance with another embodiment of the invention.

As described above in connection with FIG. 11, in that embodiment, apodization of the CMMs is provided in either the azimuth direction or the elevation direction on a single element transducer surface in such a manner as to improve the acoustical and electrical behavior of the transducer. However, improvements can be afforded by providing amplitude and/or frequency apodization in both major directions of the transducer simultaneously as shown in FIG. 12. In this regard, the embodiment of FIG. 12 is distinguished from that of FIG. 11 by the fact that CMMs 17 of the two dimensions t and w are apodized independently so as to provide the desired acoustical radiating effects required by high performance array transducers wherein a large element transducer width is desirable (i.e., a width greater than 2 wavelengths) wherein a smooth acoustical radiation pattern in elevation is required (it being noted that most NDT or high intensity ultrasound devices are designed to meet these requirements).

In FIG. 12, in the t dimension, the CMMs 17 are arranged in a pattern wherein the width dimensions thereof increase progressively from the center to the outermost edges of the element transducer 15 to create a weighting effect along the t dimension. This arrangement is provided to emphasize the "pre-accentuation" function of sensitivity and/or frequency distribution so that the acoustic response in this embodiment is improved. However, it should be understood that the pre-accentuation function can also be reversed, i.e., the arrangement can be such that the CMMs 17 decrease in size from the center to the edges, without departing from the basic principle here. In the w dimension, the arrangement and dimensional shift of the CMMs 17 can be similarly implemented. The fact is that the w dimension for a conventional array CMUT is normally much larger than the t dimension so that the apodization function applied here can be advantageously customized to obtain the results desired.

Figure 13:
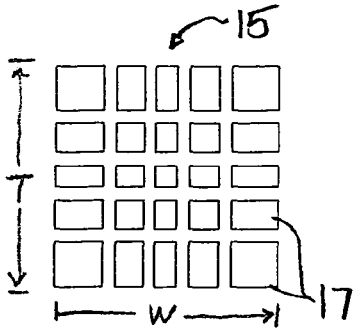
FIG. 13 is a plan view illustrating yet another method of apodizing a transducer element of CMUT matrice array in accordance with a further embodiment of the invention.
Figure 14:
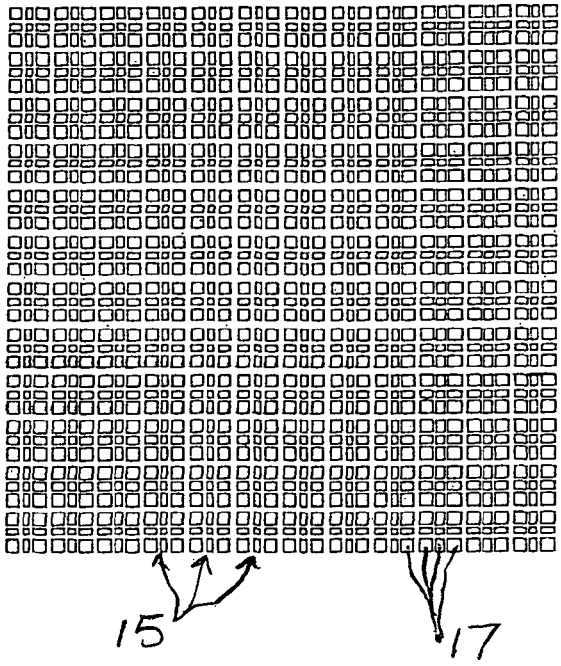
FIG. 14 is a plan view showing the front surface of a CMUT matrix array in accordance with yet another embodiment of the invention.
Figure 15:
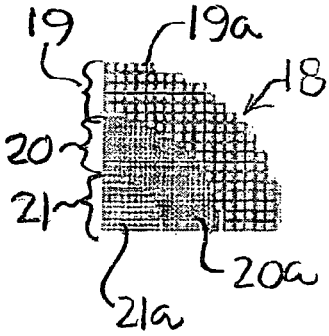
FIG. 15 is a plan view of an arrangement of CMMs for a CMUT annular array in accordance with a further embodiment of the invention.

Other variations of the preferred embodiments are illustrated in FIGS. 13, 14 and 15 in which are shown applications of these embodiments to other types of transducers such as 2D arrays and annular arrays. Because the surface of the element transducer can be customized by a particular selection of various combinations of CMMs (variations both as to shape and size), an optimized combination of CMMs can be used to provide the element transducer with a substantially perfect acoustic radiating pattern, as well as favorable electrical characteristics with regard to the corresponding pulser/receiver circuitry employed.

One example of a customized CMM combination for a square shaped element transducer surface 15 is illustrated in FIG. 13 wherein the dimension of the CMMs 17 is progressively changed from the center of the surface to the edges or external boundaries thereof, and with symmetry being maintained in both perpendicular directions. The embodiment of FIG. 13 actually provides an apodization wherein the CMMs 17 increase in size from the center area to the edges, but it will be understood that the inverse apodization can, of course, be used, and will be used as desired by the designer or required by the particular application. Further, it will also be appreciated that square and rectangular shapes for element transducer surface 15 are not the only shapes to which the method of the invention is applicable. For example, other shapes such as ovoid, circular, or polygonal can also be used.

In a further variation shown in FIG. 14, a 2D combination of CMMs 17 arranged as shown in FIG. 13 form a matrix (2D) array CMUT wherein each element transducer 15 thereof can be implemented as previously described. The matrix CMUT so obtained exhibits a unique opportunity in providing customization of the elements thereof in order to minimize inter-element cross-coupling and to reduce the side lobes when operated in strong steering positions. On the other hand, it will be understood that such apodization of the CMMs 17 can be done differently in one area of the array than another so that predetermined apodization can be implemented on the array itself, if desired. Since each CMM 17 can be defined or implemented individually, any 2D array configuration is, therefore, possible Yet another example of a combination of CMMs or groups of CMMs is disclosed in FIG. 15 for an annular array CMUT device. Annular array devices are commonly used for high performance imaging applications including continuous focusing for better lateral resolution. In such arrays, the transducer has concentric active areas that are electrically isolated from each other. The most common approach in designing annular arrays is the Fresnel model which uses the following formula to determine the radius of each element of the array:

For a $i^{th}$ ring
with Ri1=internal radius,
and Ri2=external radius, $$Ri1=\sqrt{i-1}\text{XR}$$

$$Ri2=\sqrt{i-\epsilon}\text{xR}$$

Unfortunately, annular arrays produced by this approach includes rings of unequal area and because of this, major difficulties are encountered in perfectly matching the rings to the pulser/receiver.

This difficulty can be easily overcome by using the methods of the present invention to customize the CMMs of each individual (single) ring in order to achieve similar impedances, thereby maximizing the efficiency of the resultant transducer device. In the exemplary embodiment shown in FIG. 15, an annular array 18 has three concentric rings 19, 20, 21. It will be appreciated that the number of rings employed is obviously not limited to three but the number is preferably between 2 and 20 for most applications. However, higher numbers of rings can, of course, be used. As is evident from FIG. 15, the "ring" located at the center position (ring 21) is actually a disc or circular member having only an external diameter while the other rings 19 and 20 have both internal and external dimensions that cannot overlap, according to Fresnel principles.

As shown in FIG. 15, disc 21, or the first ring, is located at the center of the device and comprises CMMs 21*a* that map the surface of the disc. It is important to note that CMMs of the same ring or element transducer of the annular array CMUT can be identically shaped or can have different shapes and dimensions so as to exhibit the desired effects. In the preferred embodiment shown in FIG. 15, element transducers having the same types of CMMs are illustrated for ease of representation and purposes of clarity.

Ring 20 is disposed adjacent to central disc 21 and comprises a plurality of CMMS 20*a* that can be the same as, or different from, those of the immediate neighboring ring.

Similarly, outer ring 19 is disposed outwardly of ring 20 and comprises CMMS 19*a*. As indicated above, additional rings can be employed if desired.

FIG. 15 illustrates am embodiment comprising rings with CMMs having dimensions which increase progressively from the center outwardly, but it will be understood that this is only one example of the many possibilities available in mapping out the annular array. For example, the difference between the internal and external diameters of a ring can decrease or diminish outwardly toward the edge of the array, and the CMMs can be shaped individually for each ring. Further, the sizes of CMMs can decrease and can be smallest at the edge of the array.

In the discussion above, one preferred embodiment of the invention has been disclosed which uses variations in the sizes of the CMMs to achieve the results desired for particular CMUT device applications. Another method of shaping the CMMs involves varying the area covered by the electrode between the CMMs of the same transducing device in order to obtain similar apodization effects. As shown in FIG. 7*b* and related figures, the covering percentage of the electrode of a CMM impacts the vibration amplitude and frequency of the membrane.

Figure 16:
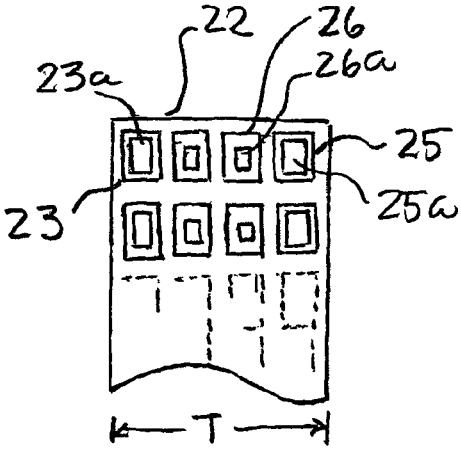
FIG. 16 is a plan view illustrating an electrode mapping method for CMMs in accordance with another embodiment of the invention.

Referring to FIG. 16, this figure further illustrates the method disclosed. In FIG. 16, element transducer 22 is a rectangular aperture having t and w dimensions (only the t dimension is labeled) which can be much different from each other. CMMs are arranged along these two perpendicular axes and are of the same shape and size. However, in this embodiment, CMMs 23, 24 and 25 have respective electrodes 23*a*, 24*a*, 25*a* which partially or totally cover the surface of the vibrating membrane of the CMMs. In the embodiment illustrated, the covering percentage of the electrodes increases from the center to the outside but this percentage can be the opposite of this without departing from the basic principle here. The variation in the electrode covering percentage can be also applied to the w dimension, with the same principle of identical or different distribution, to obtain the desired effect in this direction.

In accordance with another variation in the apodization method according to the invention, two different approaches of the various approaches described above are used in the design of the CMMS.

Although the invention has been described above in relation to preferred embodiments thereof, it will be understood by those skilled in the art that variations and modifications can be effected in these preferred embodiments without departing from the scope and spirit of the invention.

What is claimed:

1. A capacitive micromachined transducer device adapted to be coupled to associated pulser-receiver electronics, said device comprising a plurality of capacitive micromachined membrane cells forming an emitting surface wherein the dimensions of said cells varies from one portion to another of the emitting surface of the device in a manner such as to individually control the electrical impedance of the cells of the transducer so as to provide impedance matching with the associated pulser-receiver electronics;

wherein an arrangement of said cells having the same dimensions forms a portion of the emitting surface.

2. A device according to claim 1, wherein said emitting surface includes a plurality of said portions, each of said portions including cells of the same dimensions and the dimensions of the cells being different and varying between different portions of cells.

3. A method of manufacturing an array capacitive micromachined transducer device having a plurality of element apertures arranged in one of a linear, curved linear or matrix-like arrangement so as to provide a synthetic acoustic aperture, said method comprising the following steps:

providing a silicon substrate having capacitive micromachined membrane cells with different membrane configurations disposed on one major surface of the substrate and arranged so as to form a plurality of elementary acoustic apertures defined by a first dimension in azimuth and a second dimension in elevation, said cells being separated from each other by channels or kerfs defined by the absence of a cell;

cutting the silicon substrate so as to obtain a plurality of individual array transducers each having a predetermined number of elementary apertures and a predetermined pitch;

providing an assembly of the array transducers on a backing module to form the transducer device;

providing electric interconnections for elements of the array transducers; and mounting at least one of a protective front cover and a front lens on a major surface of the transducer device.

4. A method of manufacturing an array capacitive micromachined transducer device according to claim 3, further providing bending of the assembly to obtain a curved transducer device.

5. A method of manufacturing an array capacitive micromachined transducer device according to claim 3, wherein the cells of each element of the array transducers produced from the substrate have different dimensions that vary so as to produce an apodization function in at least one of amplitude and frequency in azimuth.

6. A method of manufacturing an array capacitive micromachined transducer device according to claim 3, wherein the cells of each element of the array transducer produced from the substrate have different dimensions that vary so as to provide an apodization function in at least one of amplitude and frequency in elevation.

7. A method of manufacturing an array capacitive micromachined transducer device according to claim 3, wherein the cells of each element of the array transducers produced from the substrate are of variable dimensions so as to achieve an apodization function in amplitude and/or in frequency in the azimuth and in the elevation planes simultaneously.

8. A method of manufacturing an array capacitive micromachined transducer device according to claim 3, wherein said substrate has a thickness dimension and said cutting is performed at least partially in the thickness dimension of the substrate.

9. A method of manufacturing an array capacitive micromachined transducer device according to claim 3, wherein said cutting is performed through a thickness dimension of the substrate in a manner so as to separate, from one another, all elements of the transducer device.

10. A method of manufacturing an array capacitive micromachined transducer device according to claim 3, wherein said cutting comprises a partial cutting operation using a dry etching technique.

11. A method of manufacturing an array capacitive micromachined transducer device according to claim 3, wherein said cutting comprises a through cutting operation using a dry etching technique.

* * * * *